US009721542B2

(12) United States Patent
Sperr

(10) Patent No.: US 9,721,542 B2
(45) Date of Patent: Aug. 1, 2017

(54) GUITAR CONVERSION SYSTEM AND METHOD

(71) Applicant: Eric Sperr, South Plainfield, NJ (US)

(72) Inventor: Eric Sperr, South Plainfield, NJ (US)

( * ) Notice: Subject to any disclaimer, the term of this patent is extended or adjusted under 35 U.S.C. 154(b) by 350 days.

(21) Appl. No.: 13/844,781

(22) Filed: Mar. 15, 2013

(65) Prior Publication Data

US 2017/0110097 A1 Apr. 20, 2017

(51) Int. Cl.

| | |
|---|---|
| ***G10H 1/32*** | (2006.01) |
| ***G10H 3/00*** | (2006.01) |
| ***G10D 1/08*** | (2006.01) |
| ***G10H 3/18*** | (2006.01) |

(52) U.S. Cl.

CPC ..... *G10D 1/085* (2013.01); *G10H 3/18* (2013.01)

(58) Field of Classification Search

CPC ..... G10D 1/085; G10H 3/18
USPC ..... 84/743
See application file for complete search history.

(56) References Cited

U.S. PATENT DOCUMENTS 4,247,029 A 1/1981 Levin ..... 224/271
4,254,683 A * 3/1981 Nulman ..... G10H 3/183 84/727
4,408,515 A 10/1983 Sciuto ..... 84/267
4,432,267 A * 2/1984 Feller ..... G10D 3/06 84/291
4,433,603 A * 2/1984 Siminoff ..... G10H 1/32 84/267
4,686,882 A 8/1987 Shaw ..... 84/291
4,873,908 A * 10/1989 Moore ..... G10D 1/085 211/84

(Continued)

FOREIGN PATENT DOCUMENTS

WO WO/0045371 8/2000

OTHER PUBLICATIONS

"Guitars of Tomorrow?", published in Guitar Player/Oct. 1982.
It's New, published in Guitar Player/Feb. 1981.
"Hi-Tech Guitars" published in Guitar Player/May 1982.

*Primary Examiner* — Jeffrey Donels
(74) *Attorney, Agent, or Firm* — Ernest D. Buff & Associates; Margaret A. LaCroix; Ernest D. Buff

(57) ABSTRACT

A guitar conversion system for the assembly of a guitar in an easy quick manner, from conventional guitar designs to hybrid guitars. The guitar conversion system includes at least one main body portion and at least one side body portion. Preferably a pair of side body portions is provided. The main body portion includes a headstock, machine heads (or pegheads, or tuners), a neck, and pickups in communication with electronic controls located on the side body portion. The main body portion includes left and right edge walls having attachment means for releasably attaching at least one other main body portion or at least one side body portion to the main body. The side body portion includes at least one electrical control integrated therein for electronic communication with the main body portion. The side body portion comprising a top side wall and at least one side attachment portion that is adapted to mate with the attachment means of the main body portion. The guitar conversion system provides the ability to interchange the body portion and/or each of the side body portions to change any resultant guitar thereof ranging from conventional constructs to hybrid constructs.

20 Claims, 9 Drawing Sheets

(56) References Cited

U.S. PATENT DOCUMENTS 5,315,910 A * 5/1994 Soupios ..... G10D 1/085 84/263
5,390,578 A 2/1995 Raymer ..... 84/291
5,442,986 A * 8/1995 Cota ..... G10D 1/085 84/267
5,637,823 A * 6/1997 Dodge ..... G10H 1/32 84/726
5,682,003 A * 10/1997 Jarowsky ..... G10D 3/02 84/267
5,767,432 A * 6/1998 Randolph ..... G10D 1/085 84/267
5,929,362 A * 7/1999 Oteyza ..... G10D 1/085 84/293
5,949,005 A 9/1999 Peterson ..... 84/291
5,994,633 A * 11/1999 Norton ..... G10D 1/085 84/290
6,043,422 A * 3/2000 Chapman ..... G10H 1/32 84/723
6,046,392 A 4/2000 Saul ..... 84/291
6,137,039 A 10/2000 Rose ..... 84/298
6,253,654 B1 * 7/2001 Mercurio ..... G10D 1/085 84/267
6,369,304 B1 4/2002 Tucker ..... 84/291
7,371,949 B2 5/2008 Sawhney et al. ..... 84/291
7,705,224 B1 4/2010 Ward ..... 84/267
7,893,330 B1 * 2/2011 Andreasen ..... G10D 1/085 84/291
8,378,192 B1 2/2013 Harmon ..... 84/291
9,424,818 B1 * 8/2016 Spangler ..... G10D 1/08
2003/0188622 A1 * 10/2003 Wilson ..... G10D 1/085 84/267
2005/0247183 A1 * 11/2005 Towers ..... G10D 3/06 84/298
2006/0123971 A1 * 6/2006 Moghaddam ..... G10D 1/085 84/290

* cited by examiner

GUITAR CONVERSION SYSTEM AND METHOD

BACKGROUND OF THE INVENTION

1. Field of the Invention

The present invention relates to a guitar conversion system and method, and more particularly to a guitar that can be readily assembled and disassembled.

2. Description of the Prior Art

The guitar is one of the most popular instruments utilized in the music industry, covering a vast array of music. In genres including blues, bluegrass, country, flamenco, folk, jazz, jota, mariachi, metal, punk, reggae, rock, soul, and many forms of pop, guitars are considered a primary instrument. Guitars can be divided into two broad categories, acoustic and electric. There are three main types of modern acoustic guitars, the classical guitar (nylon-string guitar), the steel-string acoustic guitar, and the arch top guitar. Vibration of strings produces the tone of an acoustic guitar, amplified by the body of the guitar, acting as a resonating chamber. Another type of guitar is the electric guitar. Electric guitars utilize an amplifier adapted to electronically manipulate tone. Electric guitars have had a continuing profound influence on popular culture.

Electric guitar bodies can be constructed having solid, semi-hollow, or hollow bodies. Conventional electric guitar bodies are constructed of solid wood. Without the use of an amplifier, electric guitars produce little sound. Electromagnetic pickups convert vibration of the steel strings into signals. Signals are then fed to an amplifier through a cable or radio transmitter. Sound is frequently modified by other electronic devices or the natural distortion of valves (vacuum tubes) in the amplifier. Magnetic pickups, passive or active, include two main types, single- and double-coil (humbucker). Electric guitars utilize techniques less frequently used on acoustic guitars owing to the electric guitars having lower fretboard action (the height of the strings from the fingerboard), lighter (thinner) strings, and its electrical amplification. Such techniques include tapping, extensive legato use through pull-offs and hammer-ons (also known as slurs), pinch harmonics, volume swells, and use of a tremolo arm or effects pedals. Hybrids of acoustic and electric guitars, including varieties of guitars with two, three, or rarely four necks, have been provided with all manners of alternate string arrangements.

Guitars can be a costly purchase for musicians and hobbyists, and many guitar enthusiasts are confronted with the cost. Bodies of electric guitars come in an array of designs, colors, shapes and sizes. Hybrid guitars and the like have become increasingly popular for musicians, however due to the specialty and custom nature of these guitars they can be quite costly and represent a substantial investment.

Costs can immediately be prohibitive when dealing with hybrid instruments or custom made guitar instruments. Expending large sums of money for a custom or hybrid guitar may not be feasible or practical for many musicians or consumers for many reasons, including cost considerations as well as change in tastes. Specifically, ones tastes can change over time so that what was once considered a "hot" custom guitar style or design may become "dated" just a short time later. Typical attempts to address this issue have fallen flat, and generally merely involve slight modifications on existing guitars.

Another problem with current guitars is that of transportability and storage. Many musicians and consumers spend a great deal of money on transportation of instrument and, specifically guitars.

Various guitar constructs have been provided that provide the ability to fold or otherwise collapse or disassemble guitars. These constructs are generally associated with the purpose of making the instrument more compact for travel and/or storage. Typically, the assembly includes a guitar body with a neck that can be removed from the body to make the instrument more compact. Other assemblies provide a neck that is pivotally connected to a guitar body so that the neck can be rotated downward or folded over the guitar body to create a compact manner for storage and or travel. These attempts have had limited success and are costly while posing risks to vigor of the instrument as the instrument is frequently taken reassembled with string re-assemblage requiring re-tuning of the instrument each time. What is more, many of the assemblies include costly materials and complex joints or string placement issues making them impractical.

There remains a need in the art for a guitar system and method that provides the ability to interchange guitar bodies with minimal manipulation of the instrument. Further, there exists a need in the art to provide the ability to construct a hybrid guitar, and deconstruct that same hybrid, in an easy manner so that a user has the ability to change the look and feel and sound of the instrument. Lastly, there is a need in the art for a guitar conversion system and method that provides for easy compact transport of the instrument.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages. The objects and advantages of the present invention, more specifically, are to provide a guitar conversion system and method that provides the ability to instantly modify or change the look, style, feel, and music or tune of a guitar or other chord instrument having a like construct. Further advantages of the present invention are to provide the further ability to pack and store the instrument in a convenient manner for carrying and traveling. Another advantage of the present invention is to provide the ability to not only change the look and feel of a guitar, but also to provide the ability to create a ready assembles guitar hybrid in a lower cost manner.

Facilitating the above-mentioned objectives, the subject invention is directed to a guitar conversion system and method that can be readily assembled and disassembled to provide a variety of different guitar constructs and designs with minimal reconstruction. The subject guitar conversion system provides for the assembly of a guitar from conventional to a hybrid constructs with minimal construction to present the ability to change guitar look and style quickly. The guitar conversion system includes a main body portion and at least one side body portion, preferably comprising at least two side body portions formed as left and right portions. Main body portion has a headstock, nut, machine heads (or pegheads, tuning keys, tuning machines, tuners), a neck, and pickups in communication with electronic controls located on the side body portion. The main body portion further includes left and right edge walls each having at least one attachment means formed as apertures within the edge walls of main body portion. The side body portion preferably includes left and right primary segments as left and right portions. The side body portion is adapted to be removably attached to a side wall of the main body portion and includes at least one electrical control integrated therein for electronic communication. Right and left primary segments are generally constructed having a primary segment with a top side wall and at least one side attachment point portion. Preferably, the side attachment points are constructed with apertures having a pipe portion (or attachment portion) therein that are appointed to be received within attachment points of main body portion. An electrical input for electronic communication with electronic controls of right primary segment of side body portion is preferably provided for attachment and electrical communication with main body portion. Inset screws are preferably provided within the main body portion and segments for securing pipe portions. The side body portions can be cut and formed into a plethora of shapes, sizes and configurations, and colored or painted in a variety of designs.

In one aspect of the present invention a guitar conversion system for the assembly of a guitar in an easy quick manner, from conventional guitar designs to hybrid guitars is provided. The guitar conversion system includes at least one main body portion and at least one side body portion. Preferably a pair of side body portions is provided. The main body portion includes a headstock, machine heads (or pegheads, or tuners), a neck, and pickups in communication with electronic controls located on the side body portion. The main body portion includes left and right edge walls having attachment means for releasably attaching at least one other main body portion or at least one side body portion to the main body. The side body portion includes at least one electrical control integrated therein for electronic communication with the main body portion. The side body portion comprising a top side wall and at least one side attachment portion that is adapted to mate with the attachment means of the main body portion. The guitar conversion system provides the ability to interchange the body portion and/or each of the side body portions to change any resultant guitar thereof ranging from conventional constructs to hybrid constructs.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Certain terminology is used in the following description for convenience only and is not limiting. The article "a" is intended to include one or more items. Where only one item is intended, the term "one" or similar language is used. Additionally, to assist in the description of the present invention, words such as top, bottom, front, rear, right and left are used to describe the accompanying figures. The terminology includes the words above specifically mentioned, derivatives thereof, and words of similar import.

The present invention's system provides the ability for a user to change a guitar from various conventional constructs to hybrid constructs with minimal assembly. The subject guitar conversion system provides for the assembly of a guitar from conventional to a hybrid constructs with minimal construction to present the ability to change guitar look and style quickly. The guitar conversion system includes a main body portion and at least one side body portion, preferably comprising at least two side body portions formed as left and right portions. Main body portion has a headstock, nut, machine heads (or pegheads, tuning keys, tuning machines, tuners), a neck, and pickups in communication with electronic controls located on the side body portion. The main body portion further includes left and right edge walls each having at least one attachment means formed as apertures within the edge walls of main body portion. The side body portion preferably includes left and right primary segments as left and right portions. The side body portion is adapted to be removably attached to a side wall of the main body portion and includes at least one electrical control integrated therein for electronic communication. Right and left primary segments are generally constructed having a primary segment with a top side wall and at least one side attachment point portion. Preferably, the side attachment points are constructed with apertures having a pipe portion (or attachment portion) therein that are appointed to be received within attachment points of main body portion. An electrical input for electronic communication with electronic controls of right primary segment of side body portion is preferably provided for attachment and electrical communication with main body portion. Inset screws are preferably provided within the main body portion and segments for securing pipe portions. The side body portions can be cut and formed into a plethora of shapes, sizes and configurations, and colored or painted in a variety of designs.

Any solid string instrument configuration may be utilized by the main body portion of the guitar conversion assembly. Specifically, the main body portion may have six (6) strings, eight (8) strings, four (4) string bass, and/or six (6) string bass.

Figure 1:
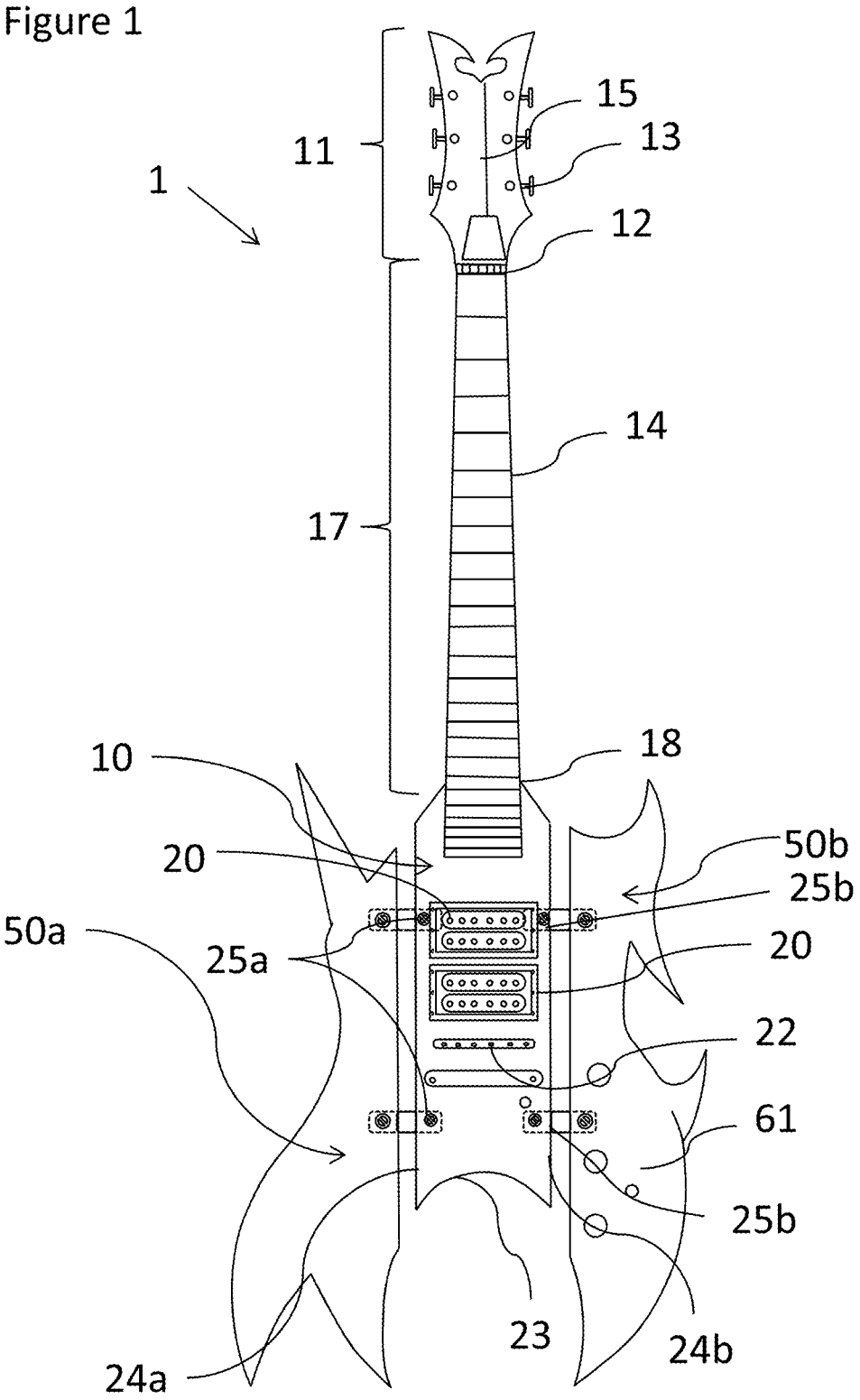
FIG. 1 is a schematic diagram of an embodiment of the subject guitar conversion system showing a guitar in the assembled condition.
Figure 2:
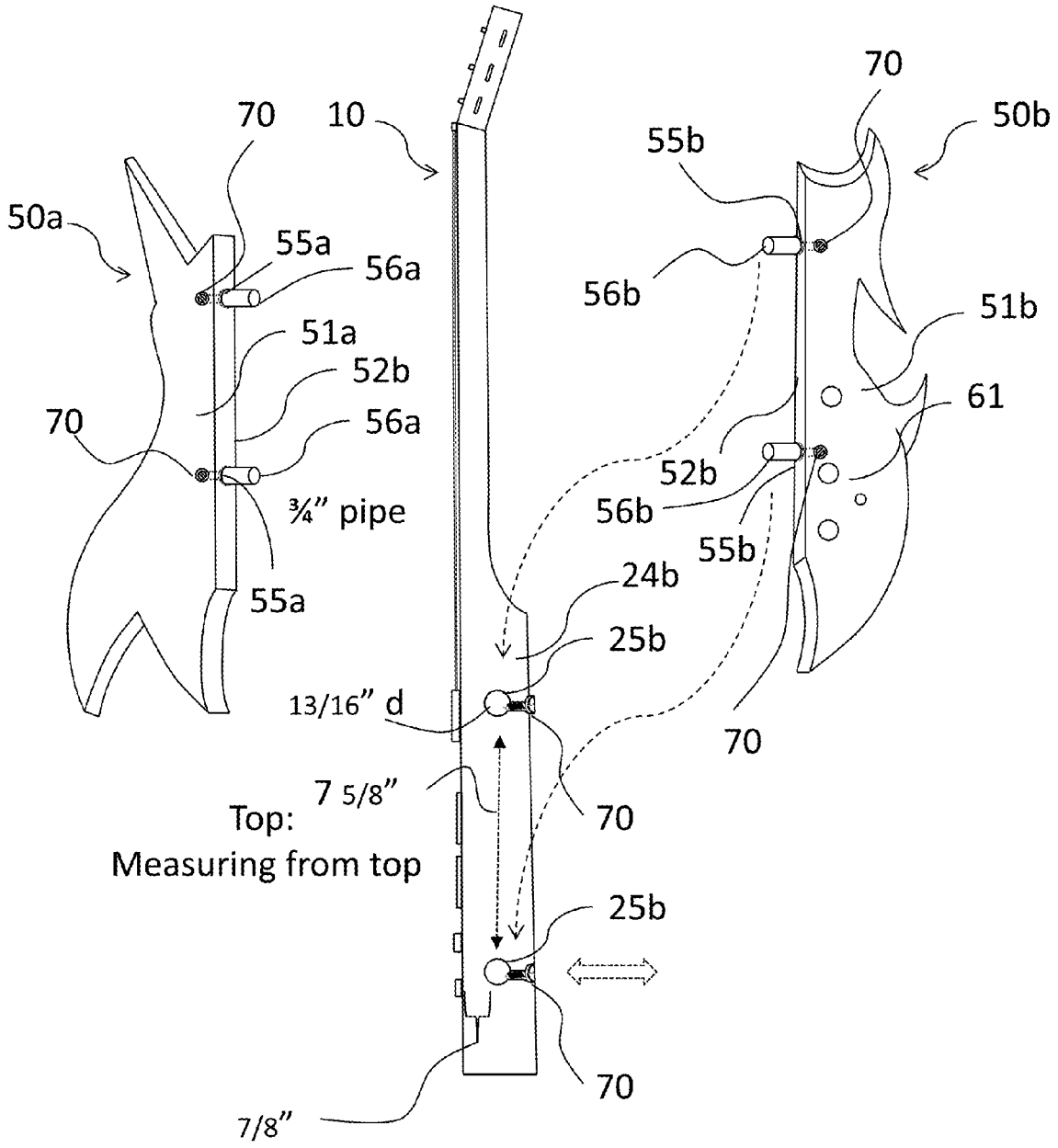
FIG. 2 is a schematic diagram of an embodiment of the subject guitar conversion system showing a guitar in the disassembled condition.
Figure 3:
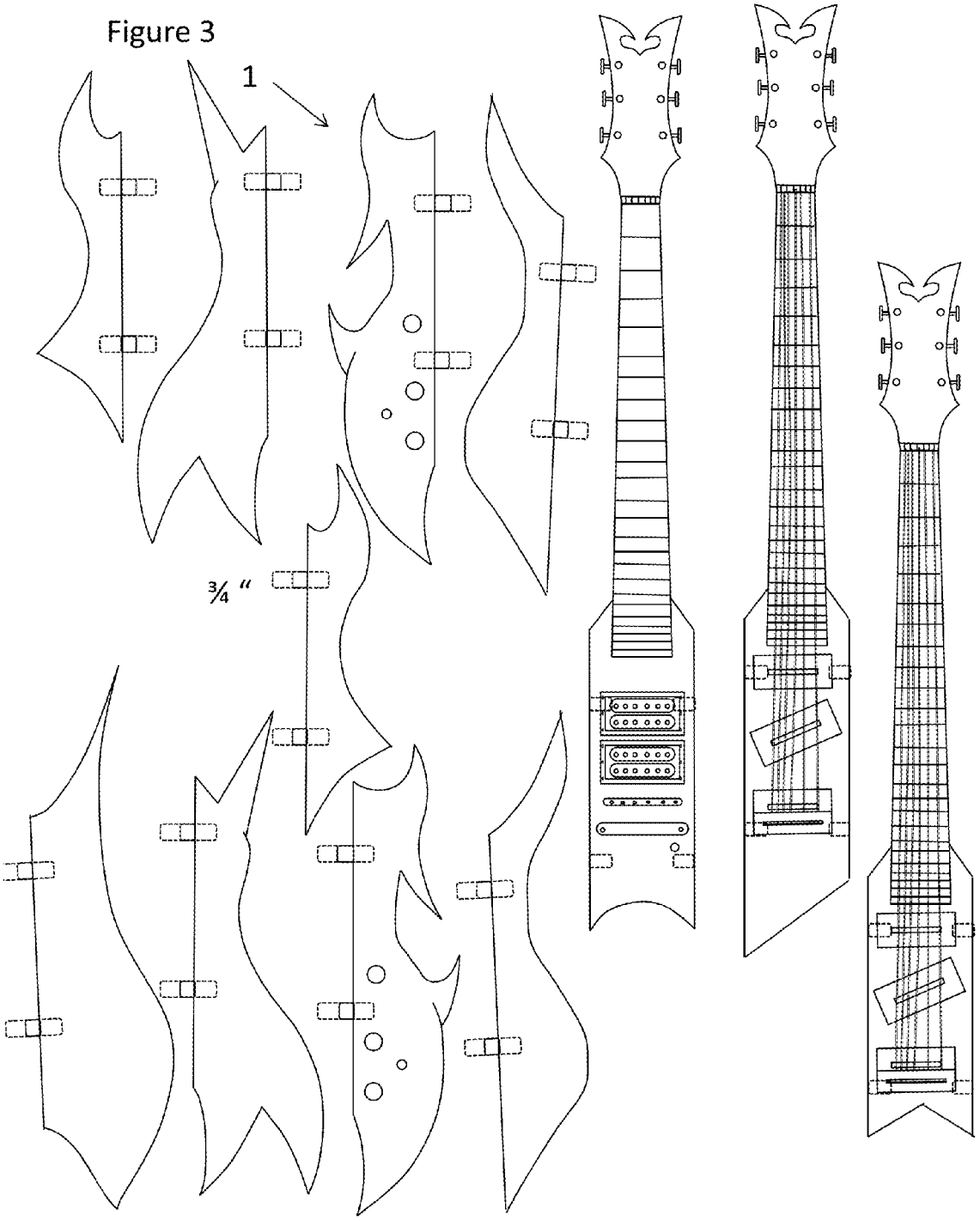
FIG. 3 is a schematic diagram of an embodiment of the subject guitar conversion system showing a plethora of main body and side body members which can be assembled together to form a conventional guitar or a hybrid guitar.

FIGS. 1-3 broadly illustrate embodiments of the subject guitar conversion system. Referring to FIGS. 1-3, an embodiment of the subject guitar conversion system is shown generally at 1. The subject guitar conversion system 1 is generally comprised of a main body portion 10 and at least one side body portion 50; preferably comprising at least two side body portions 50*a*, 50*b* (shown in FIGS. 1 and 2) formed as left and right portions; and most preferably comprising a plurality of side body portions 50*a* to n (n being any numeral greater than 1) (shown in FIG. 3) for interchangeability in forming the desired guitar.

Main body portion 10 has a headstock 11, nut 12, machine heads (or pegheads, tuning keys, tuning machines, tuners) 13, frets 14, truss rod 15, and a neck 17. A portion of neck 17 terminates at a heel (acoustic) neckjoint (electric) 18. Pickups 20 are further provided on the main body portion 10 that are in communication with electronic controls 61 located on the side body portion 50*b*. Main body portion 10 further includes a bridge 22 and terminates at a distal end 23. Main body portion 10 further includes left and right edge walls 24*a*, 24*b* (taken from top view), each having at least one attachment point; preferably each edge wall 24*a*, 24*b* has at least two attachment points 25*a*, 25*b* (shown). Main body portion 10 may include a plurality of attachment points 25*a* through n (n being any number greater than 1). Attachment points 25*a*, 25*b* are preferably constructed as apertures formed (i.e. drilled) within edge walls 24*a*, 24*b* of main body portion 10.

Wires (not shown) for carrying electronic signals are set within main body portion 10 and extend through attachment points 25*a* and/or 25*b*. An electrical outlet for electronic communication with electronic controls 61 of side body portion 50 is preferably provided within attachment points 25*a* and/or 25*b*.

Side body portion 50 preferably includes left and right primary segments 50*a* and 50*b*, respectively. As best viewed in FIG. 2, right primary segment 50*b* is adapted to be removably attached to the right side wall 24*b* of main body portion 10; left primary segment 50*a* is adapted to be removably attached to the left side wall 24*a* of main body portion 10. Right primary segment 50*b* is generally constructed having a primary segment 51*b* with a top side wall 52*b*. Left primary segment 51*a* is generally constructed having a primary segment 51*a* with a top side wall 52*a*. Side body portion 50 can be cut and formed into a plethora of shapes, sizes and configurations, and colored or painted in a variety of designs. Right primary segment 51*b* has electronic control 61 integrated therein for electronic communication through wires within main body portion 10 through attachment points 25*b*. Top side wall 52*a*, 52*b* includes at least one side attachment point preferably at least two side attachment points 55*a*, 55*b* (shown) are provided. Side attachment points 55*a*, 55*b* are constructed with apertures having a pipe portion (or attachment portion) 56*a*, 56*b* therein that are appointed to be received within attachment points 25*a*, 25*b* of main body portion 10. Wires (not shown) for carrying electronic signals are set within segment 50*b* and extend through side attachment points 25*b* of right segment 50*b*. An electrical input for electronic communication with electronic controls 61 of right primary segment 50*b* of side body portion 50 is preferably provided within pipe portion 56*b* for attachment and electrical communication with main body portion 10. Inset screws 70 are provided within the main body portion 10 and segments 50*a* and 50*b* for securing pipe portions 56*a*, 56*b*.

Figure 4:
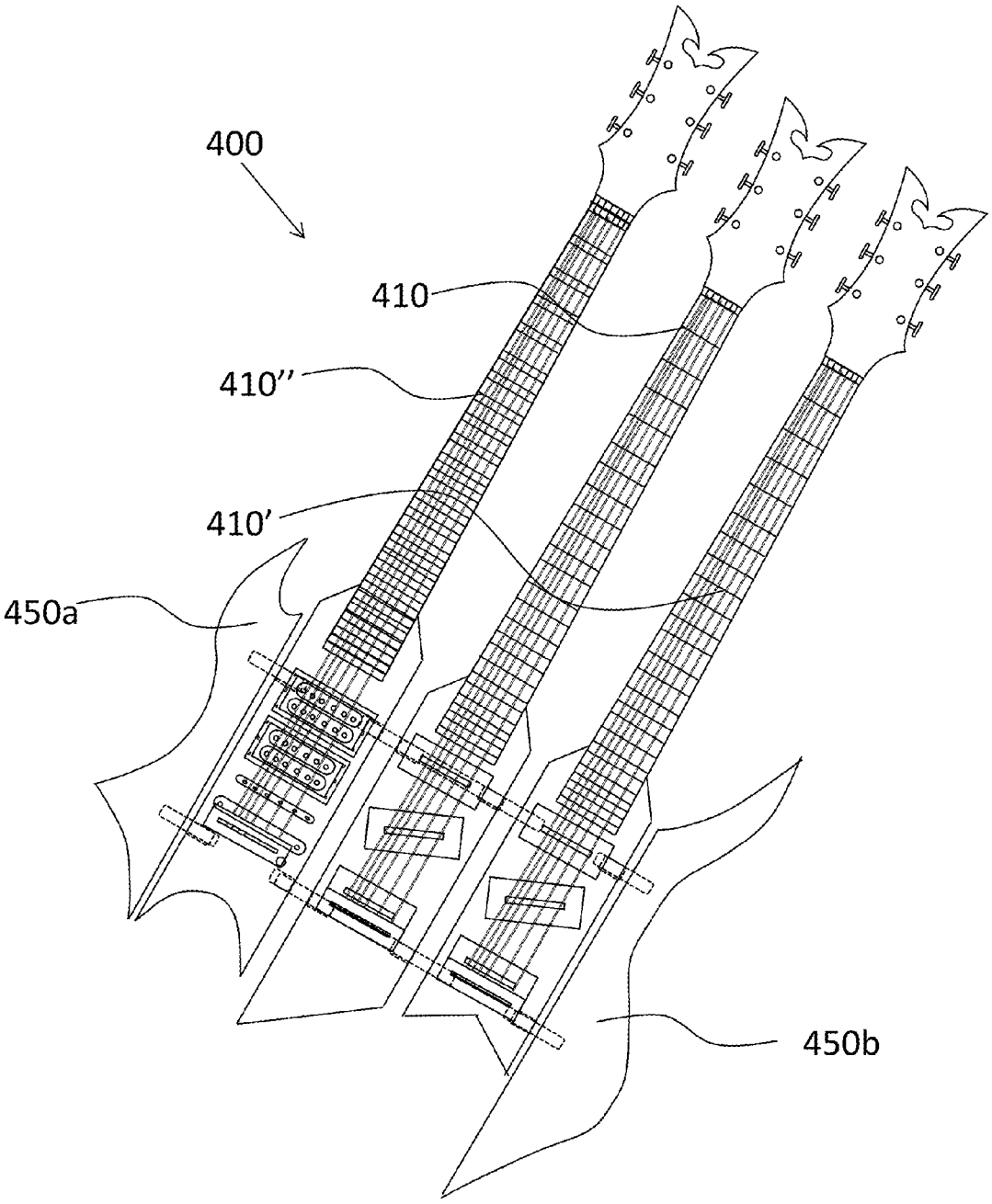
FIG. 4 is a view diagram of an embodiment of the subject guitar conversion system showing a hybrid guitar assembled from the system.

FIG. 4 is a view diagram of an embodiment of the subject guitar conversion system showing a hybrid guitar assembled from the system, shown generally at 400. In the view shown, a plurality of main body portions 410', 410, 410", herein three, are attached to one another through the attachment points as described hereinabove relating to FIGS. 1-3. Left and right primary segments 450*a* and 450*b* side body portions are attached to the outer lying main body portions 410' and 410".

Figure 5A:
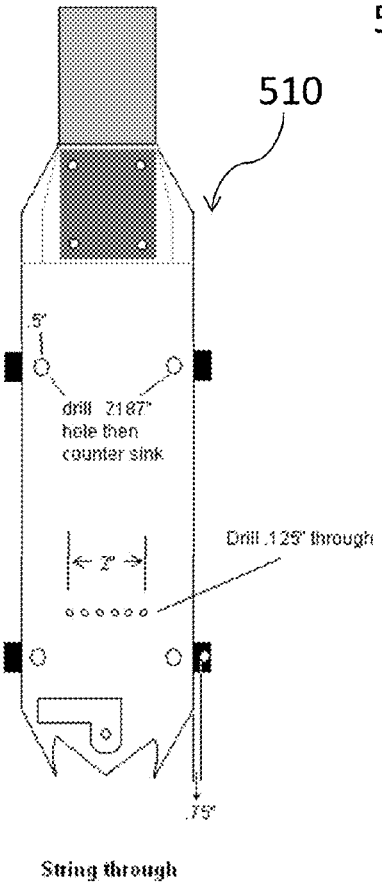
FIG. 5*a* is a schematic diagram of an embodiment of the subject guitar conversion system showing the back of a main body portion.
Figure 5B:
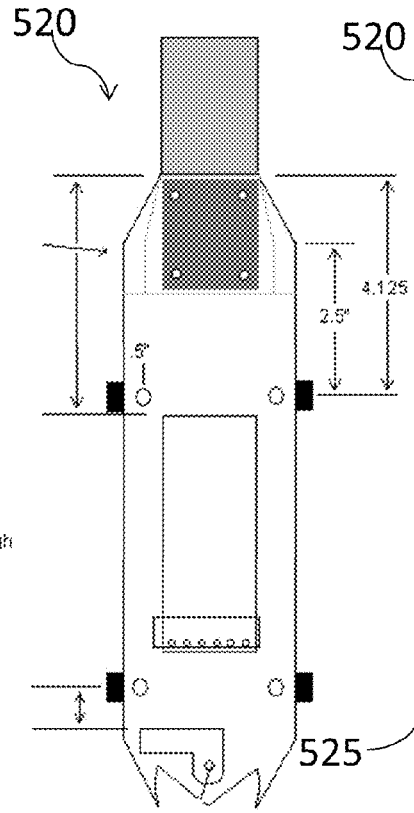
FIG. 5*b* is another view of the main body portion of FIG. 5*a;*
Figure 5C:
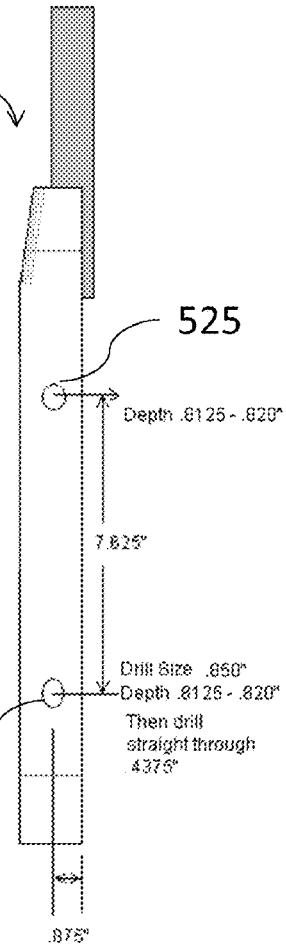
FIG. 5*c* is a side view of the back of a main body portion of FIG. 5*a;*

FIGS. 5*a*-5*c* illustrate schematic views of construction of an embodiment of the main body portion. FIG. 5*a* is a schematic diagram of an embodiment of the subject guitar conversion system showing the back of a main body portion, shown generally at 510. FIG. 5*b* is another view of the main body portion of FIG. 5*a*, shown generally at 520. Lastly, FIG. 5*c* is a side view of the back of a main body portion of FIG. 5*a*, shown generally at 530, showing attachment points on the edge wall herein shown at 525. The figures set forth preferred measurement constructs in forming the main body member of the subject invention.

Figure 6A:
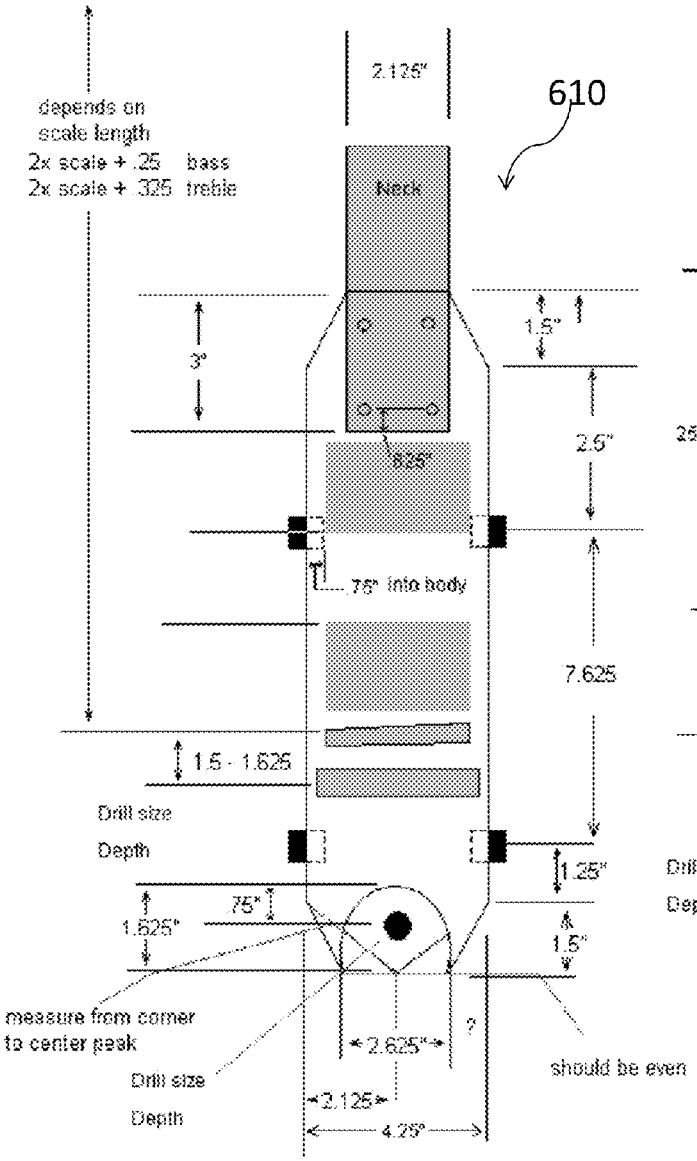
FIG. 6*a* is a schematic diagram of an embodiment of the subject guitar conversion system showing the front of a main body portion having a 6 string with Tune o Matic and tail piece.
Figure 6B:
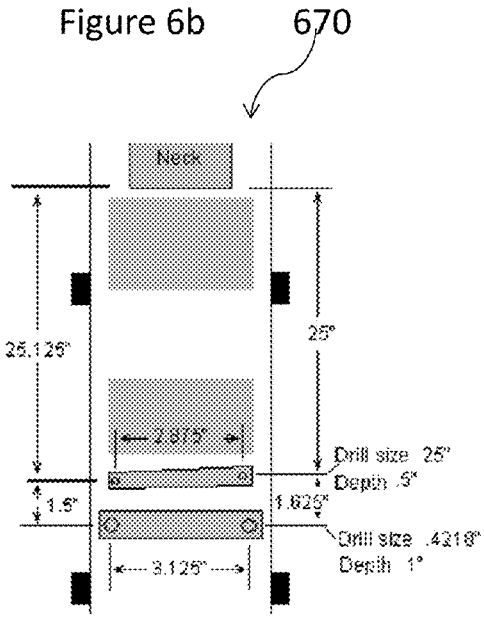
FIG. 6*b* is another view of the main body portion of FIG. 6*a;*
Figure 6C:
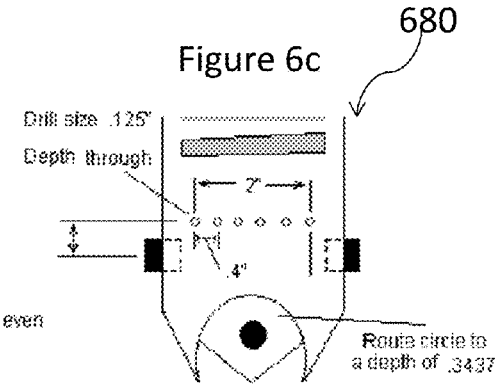
FIG. 6*c* is an alternate view of FIG. 6*a* without the tail piece.

FIGS. 6*a*-6*c* illustrate schematic views of construction of an embodiment of the main body portion. FIG. 6*a* is a schematic diagram of an embodiment of the subject guitar conversion system showing the front of a main body portion having a 6 string with Tune o Matic and tail piece, shown generally at 610. FIG. 6*b* is another view of the main body portion of FIG. 6*a*, shown generally at 670. Lastly, FIG. 6*c* is an alternate view of FIG. 6*a* without the tail piece, shown generally at 680.

Figure 7:
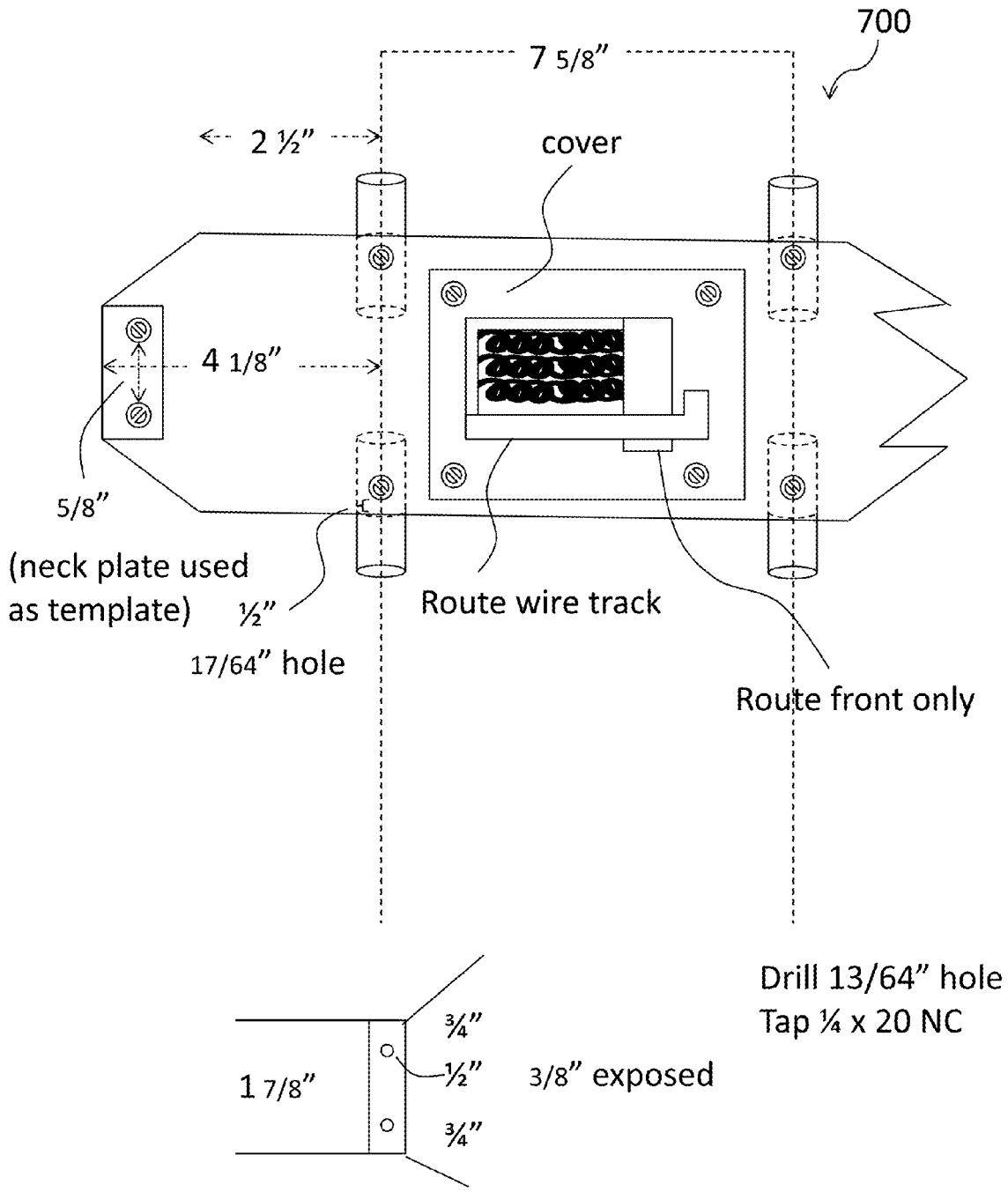
FIG. 7 is a schematic diagram of an embodiment of construction of the main body portion.

FIG. 7 is a schematic diagram of an embodiment of construction of the main body portion, shown generally at 700.

Figure 8:
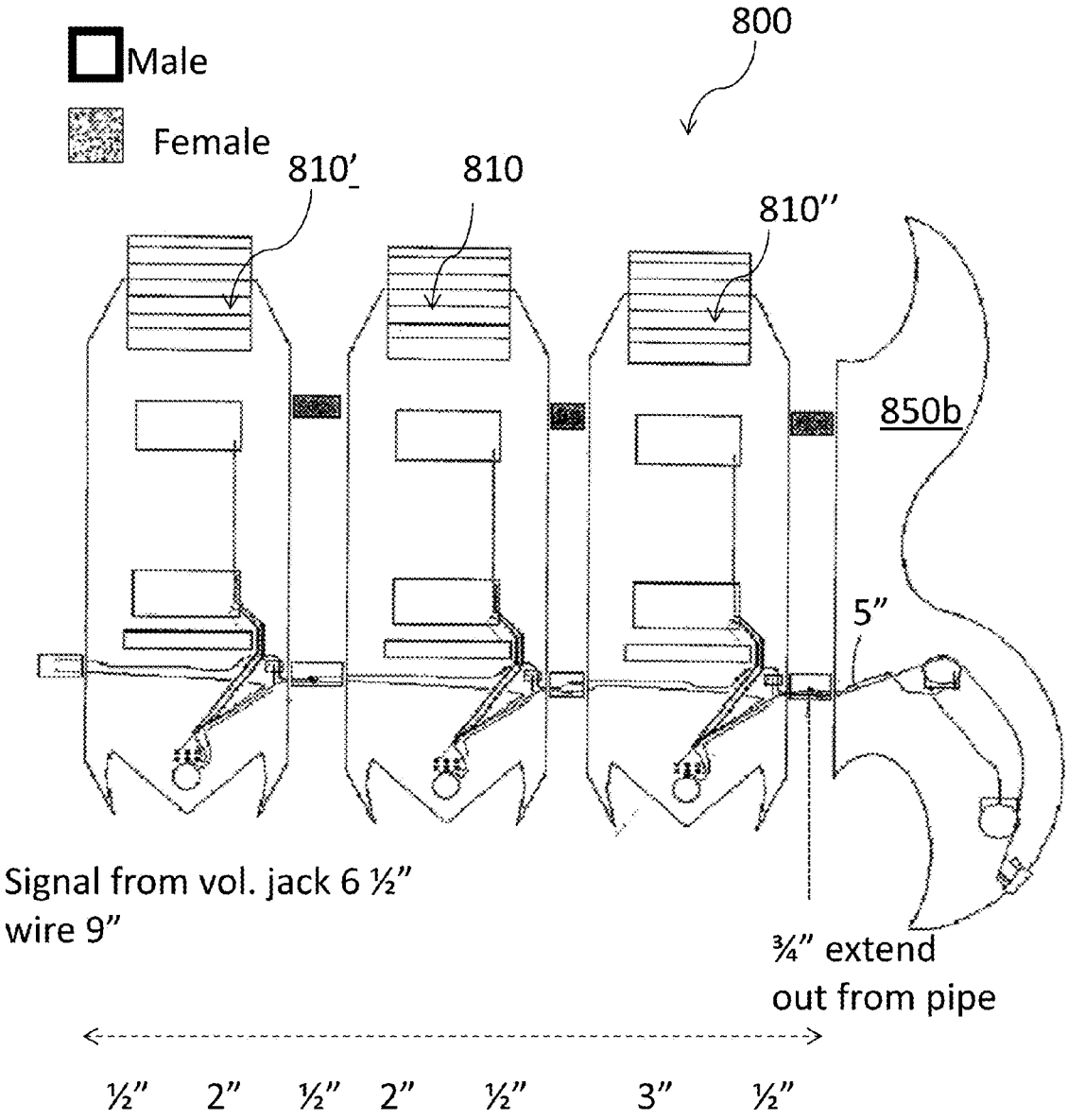
FIG. 8 is a schematic diagram of an embodiment of the electronic wiring for the subject guitar conversion system.
Figure 9:
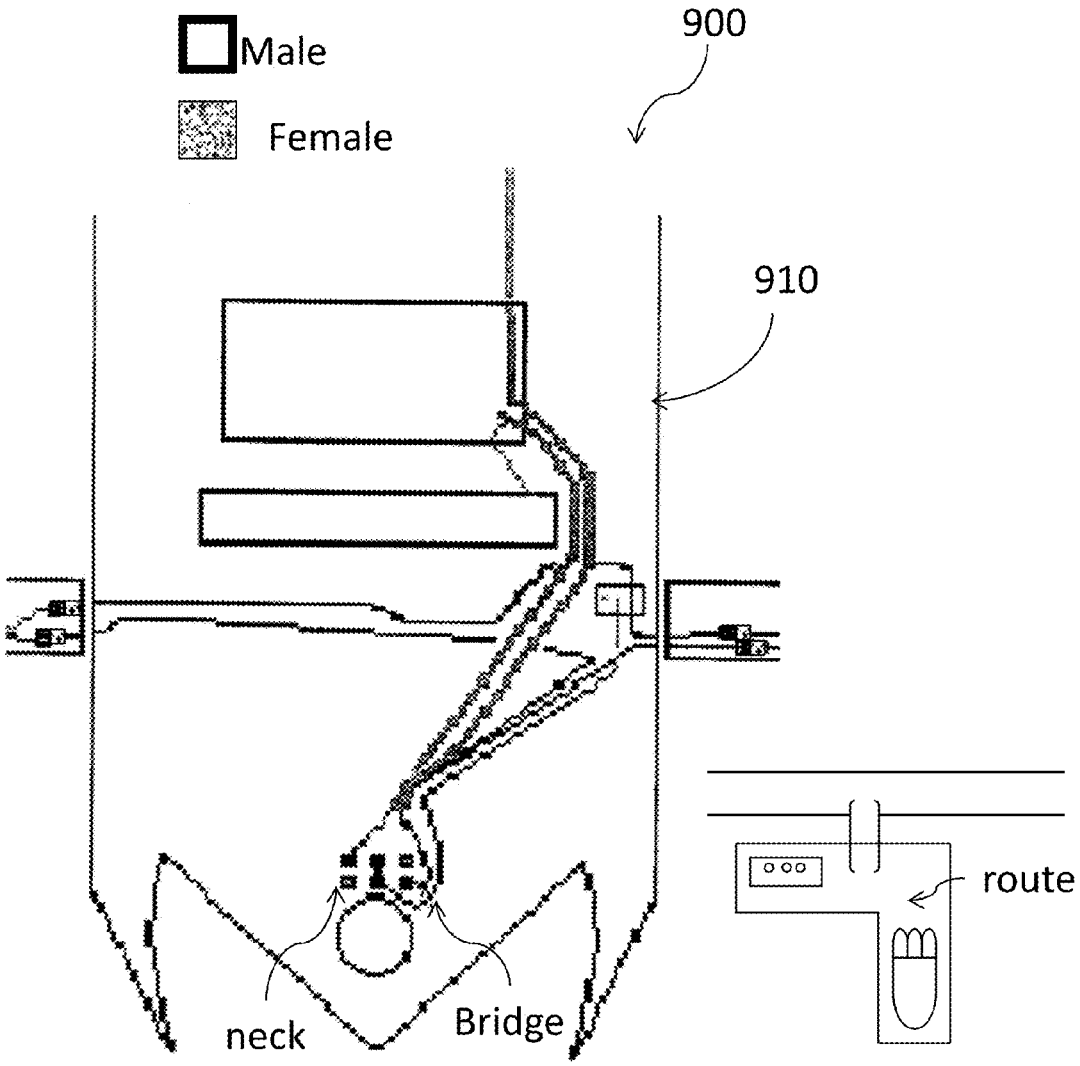
FIG. 9 is an exploded view of the electronic wiring for the subject guitar conversion system.

FIGS. 8 and 9 detail electronic wiring of the subject guitar conversion system, wherein FIG. 8 is a schematic diagram of an embodiment of the electronic wiring for the subject guitar conversion system, shown generally at 800. FIG. 8 illustrates wiring from main body portions 810', 810, and 810" to side portion 850*b* as in the hybrid set forth hereinabove regarding FIG. 4. FIG. 9 is an exploded view of the electronic wiring of a main body member 910 for the subject guitar conversion system shown at 900.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A guitar conversion system for the assembly of a guitar, comprising:

a. at least two main body portions and at least one side body portion;

b. said at least two main body portions having a headstock, machine heads (or pegheads, or tuners), a neck, and pickups in communication with electronic controls located on said at least one side body portion;

c. said at least two main body portions further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least two main body portions;

wherein said guitar conversion system provides the ability to interchange said at least two main body portions and said at least one side body portion to form said guitar having a conventional construct or a hybrid construct.

2. A guitar conversion system as recited by claim 1, wherein said at least two main body portions further comprise a nut.

3. A guitar conversion system as recited by claim 1, wherein there are at least two side body portions.

4. A guitar conversion system as recited by claim 1, wherein there is a pair of side body portions and each side body portion is a handedness in said pair, specifically, a right side body portion and a left side body portion.

5. A guitar conversion system as recited by claim 1, wherein said at least two main body portions include at least four strings.

6. A guitar conversion system as recited by claim 1, wherein said at least two main body portions include at least six strings.

7. A guitar conversion system as recited by claim 1, wherein said at least two main body portions' attachment means are constructed as apertures adapted to receive therein said side attachment portion of said at least one side body portion.

8. A guitar conversion system as recited by claim 1, wherein said at least two main body portions' attachment means are formed as at least one aperture having a pipe portion fitting within said at least one aperture.

9. A guitar conversion system as recited by claim 1, wherein said system is provided as a kit comprising a main carry case and at least two main body portions and at least one side body portion.

10. A guitar conversion system as recited by claim 1, wherein said at least one side body portion's attachment means is formed as at least one aperture having a pipe portion fitting within said at least one aperture.

11. A guitar conversion system as recited by claim 1, wherein said at least two main body portions comprise internal wiring providing communication with said electronic controls of said at least one side body portion, and wherein said at least two main body portions' and aid at least one side body portion's mating attachment means act as conduits for transmitting electricity from said at least one side body portion to said at least two main body portions.

12. A guitar conversion system as recited by claim 1, wherein said at least two main body portions comprise an internal wiring inlet/outlet or adapter that is readily received within a wiring outlet/inlet of said at least one side body portion for direct plug-in of electricity from said at least one side body portion to said at least two main body portions.

13. A guitar conversion system as recited by claim 1 comprising inset screws provided within said at least two main body portions and said at least one side body portion for securing said main body and side body portions together.

14. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said at least one main body portion;

e. said at least one side body portion comprising a top side wall and at least one side attachment portion that is adapted to mate with said attachment means of said at least one main body portion; and f. said at least one main body portion's attachment means being constructed as apertures adapted to receive therein said side attachment portion of said at least one side body portion;

wherein said guitar conversion system provides the ability to interchange said at least one main body portion and said at least one side body portion to form said guitar having a conventional construct or a hybrid construct.

15. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. said at least one main body portion's attachment means being formed as at least one aperture having a pipe portion fitting within said at least one aperture;

wherein said guitar conversion system provides the ability to interchange said at least one main body portion and said at least one side body portion to form said guitar having a conventional construct or a hybrid construct.

16. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. said system being provided as a kit comprising a main carry case and at least one main body portion and at least one side body portion;

wherein said guitar conversion system provides the ability to interchange said at least one main body portion and said at least one side body portion to form said guitar having a conventional construct or a hybrid construct.

17. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. said at least one side body portion's attachment means being formed as at least one aperture having a pipe portion fitting within said at least one aperture;

wherein said guitar conversion system provides the ability to interchange said at least one main body portion and said at least one side body portion to form said guitar having a conventional construct or a hybrid construct.

18. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. said at least one main body portion comprising internal wiring providing communication with said electronic controls of said at least one side body portion, and wherein said at least one main body portion's and said at least one side body portion's mating attachment means act as conduits for transmitting electricity from said at least one side body portion to said at least one main body portion;

wherein said guitar conversion system provides the ability to interchange said at least one main body portion and said at least one side body portion to form said guitar having a conventional construct or a hybrid construct.

19. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. said at least one main body portion comprising an internal wiring inlet/outlet or adapter that is readily received within a wiring outlet/inlet of said at least one side body portion for direct plug-in of electricity from said at least one side body portion to said at least one main body portion;

wherein said guitar conversion system provides the ability to interchange said at least one main body portion and said at least one side body portion to form said guitar having a conventional construct or a hybrid construct.

20. A guitar conversion system for the assembly of a guitar, comprising:

a. at least one main body portion and at least one side body portion;

b. said at least one main body portion having a headstock, machine heads (or pegheads, or tuners), a neck, and pickups in communication with electronic controls located on said at least one side body portion;

c. said at least one main body portion further comprising left and right edge walls, each having at least one attachment means for releasably attaching at least one other main body portion or at least one side body portion;

d. said at least one side body portion having at least one electrical control integrated therein for electronic communication with said main body portion;

e. said at least one side body portion comprising a top side wall and at least one side attachment portion that is adapted to mate with said attachment means of said at least one main body portion; and f. inset screws provided within said at least one main body portion and said at least one side body portion for securing said main body and side body portions together;

wherein said guitar conversion system provides the ability to interchange said at least one main body portion and said at least one side body portion to form said guitar having a conventional construct or a hybrid construct.

* * * * *